US008916808B2

(12) United States Patent
Okuda et al.

(10) Patent No.: US 8,916,808 B2
(45) Date of Patent: Dec. 23, 2014

(54) INDUCTION HEATING COOKING DEVICE

(75) Inventors: Sunao Okuda, Shiga (JP); Tomoya Fujinami, Shiga (JP); Naoaki Ishimaru, Shiga (JP); Akira Kataoka, Shiga (JP)

(73) Assignee: Panasonic Corporation, Osake (JP)

( * ) Notice: Subject to any disclaimer, the term of this patent is extended or adjusted under 35 U.S.C. 154(b) by 575 days.

(21) Appl. No.: 13/146,698

(22) PCT Filed: Sep. 8, 2009

(86) PCT No.: PCT/JP2009/004433
§ 371 (c)(1),
(2), (4) Date: Jul. 28, 2011

(87) PCT Pub. No.: WO2010/086923
PCT Pub. Date: Aug. 5, 2010

(65) Prior Publication Data

US 2011/0284524 A1 Nov. 24, 2011

(30) Foreign Application Priority Data

Jan. 28, 2009 (JP) ..... 2009-016200
May 22, 2009 (JP) ..... 2009-123773

(51) Int. Cl.
*H05B 6/12* (2006.01)
*H05B 6/06* (2006.01)

(52) U.S. Cl.
CPC ..... *H05B 6/062* (2013.01); *H05B 2213/07* (2013.01)
USPC ..... 219/622

(58) Field of Classification Search
CPC ..... H05B 1/02; H05B 1/0202; H05B 1/0258; H05B 1/0261; H05B 1/0266; H05B 6/06; H05B 6/062; H05B 6/12; H05B 6/1263; H05B 6/6455; H05B 6/687; H05B 2206/02; H05B 2206/023
USPC ..... 219/448.11, 448.13, 620, 622, 623, 219/625, 626, 627, 711
See application file for complete search history.

(56) References Cited

U.S. PATENT DOCUMENTS 6,084,216 A 7/2000 Slegt et al.
6,229,130 B1 * 5/2001 Furuta et al. ..... 219/711
(Continued)

FOREIGN PATENT DOCUMENTS

CN 1246785 A 3/2000
DE 4104677 A1 8/1992
(Continued)

OTHER PUBLICATIONS

International Search Report for International Application No. PCT/JP2009/004433, dated Dec. 1, 2009, 3 pages.
(Continued)

*Primary Examiner* — Dana Ross
*Assistant Examiner* — Brandon Harvey
(74) *Attorney, Agent, or Firm* — Brinks Gilson & Lione

(57) ABSTRACT

The present invention provides an inductive heating cooking device capable of detecting a temperature of a bottom of a pan instantly without delay in detection of temperature, and precisely keeping a temperature of a cooking container constant, and control method thereof, and control program thereof. The inductive heating cooking device includes a top plate (103) on which a cooking container is placed, a heating coil (104) to which a high-frequency current is applied to generate an induction magnetic field for heating the cooking container, an input unit (114) configured to receive a command for keeping a temperature of the cooking container at a constant temperature, a control unit (105) configured to control a heating of the cooking container by controlling the high-frequency current to be applied to the heating coil, and an infrared ray sensor (106) configured to detect an infrared ray energy radiated from the cooking container through the top plate. The control unit (105) controls the high-frequency current to be applied to the heating coil based on an output of the infrared ray sensor so as to keep the temperature of the cooking container at the constant temperature according to the command received by the input unit.

4 Claims, 10 Drawing Sheets

(56) References Cited

U.S. PATENT DOCUMENTS

| | | | | |
|---|---|---|---|---|
| 6,350,968 | B1 | 2/2002 | Connolly | |
| 8,610,036 | B2 * | 12/2013 | Ewell et al. | 219/492 |
| 2005/0016988 | A1 * | 1/2005 | Harwell et al. | 219/482 |
| 2006/0081607 | A1 * | 4/2006 | Niiyama et al. | 219/497 |
| 2008/0223852 | A1 * | 9/2008 | Bassill et al. | 219/647 |
| 2009/0152260 | A1 * | 6/2009 | Fujinami et al. | 219/600 |

FOREIGN PATENT DOCUMENTS

| | | | |
|---|---|---|---|
| EP | 0379782 | A2 | 8/1990 |
| JP | 04-055794 | U | 5/1992 |
| JP | 11-332734 | A | 12/1999 |
| JP | 2004-111055 | A | 4/2004 |
| JP | 2006-286441 | A | 10/2006 |
| JP | 2006-343006 | A | 12/2006 |
| JP | 2006343006 | A * | 12/2006 |
| JP | 2009-110922 | A | 5/2009 |
| WO | WO2008/117910 | A1 | 10/2008 |
| WO | WO 2008155923 | A1 * | 12/2008 |

OTHER PUBLICATIONS

International Preliminary Report on Patentability for International Application No. PCT/JP2009/004433, dated Sep. 12, 2011, 5 pages.
Extended Search Report from corresponding European patent application No. 09839115.4 dated Aug. 19, 2014, 6 pages.

* cited by examiner

Fig.13
| TEMPERATURE OF COOKING CONTAINER | COOLING TIME |
|---|---|
| 90°C | 20 SECONDS |
| 95°C | 12 SECONDS |
| 98°C | 7 SECONDS |
| 102°C | 3 SECONDS |
| 105°C | 1 SECOND |
Fig.14A
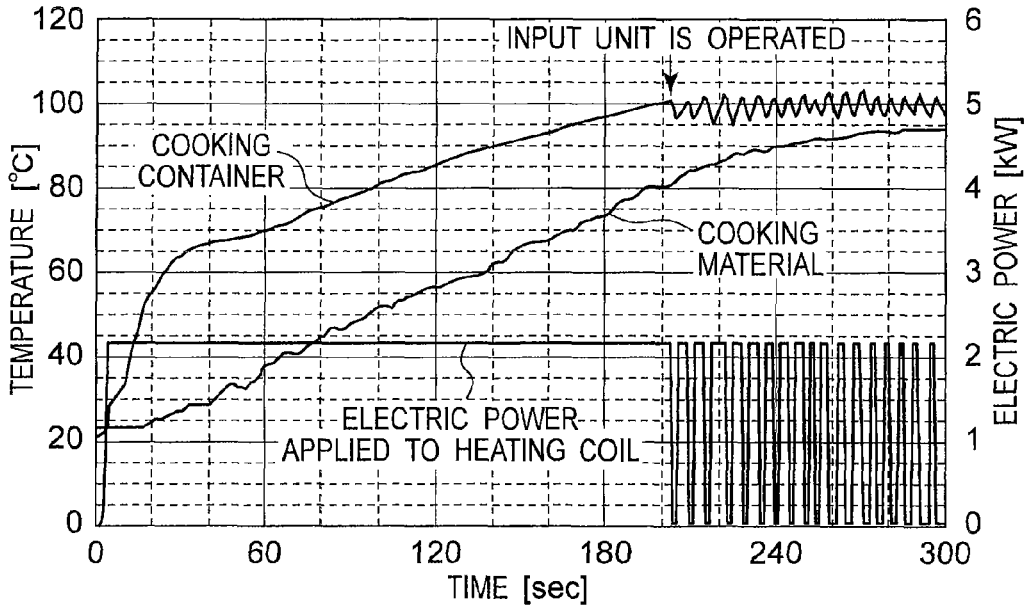
Fig.14B
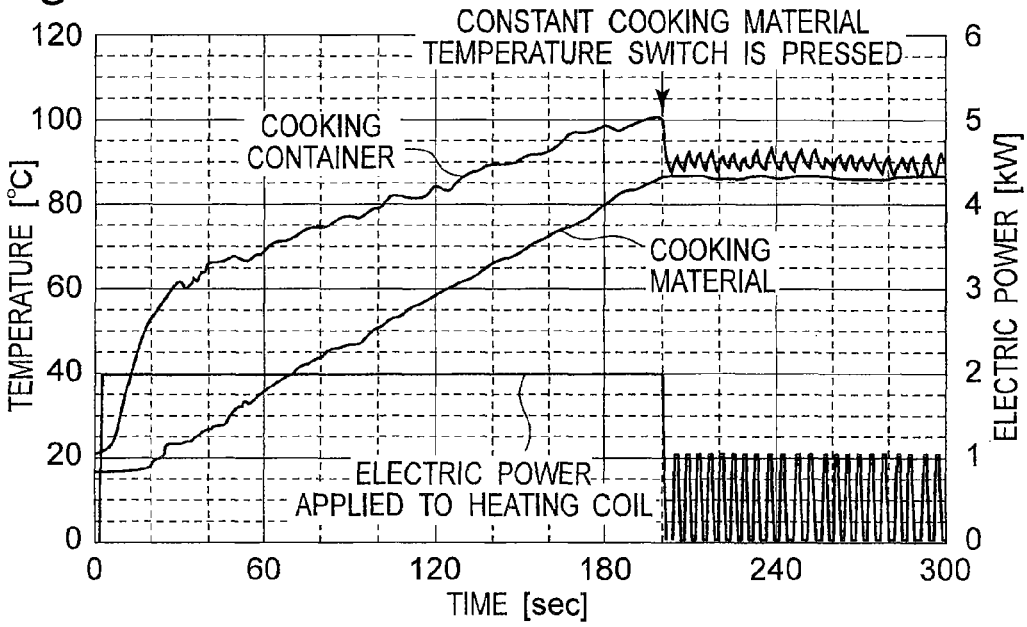

INDUCTION HEATING COOKING DEVICE

This application is a 371 application of PCT/JP2009/004433 having an international filing date of Sep. 8, 2009 which claims priority to JP2009-016200 filed Jan. 28, 2009 and JP2009-123773 filed May 22, 2009, the entire contents of which are incorporated herein by reference.

TECHNICAL FIELD

The present invention relates to an inductive heating cooking device for heating a cooking container inductively, more particularly to an inductive heating cooking device having a heat retaining function for keeping a temperature of the cooking container constant, control method thereof, and control program thereof.

BACKGROUND ART

A conventional inductive heating cooking device is provided with a heat retaining function for keeping a temperature of a cooking container constant by arranging a thermistor or other heat sensitive element on a lower surface of a top plate to detect a temperature of a cooking container (see, for example, Patent Document 1).

Patent Document 1: JP4-55794U

SUMMARY OF INVENTION

Technical Problem

In the conventional configuration, however, since the top plate is located between the cooking container and the heat sensitive element, the heat of the cooking container is transmitted to the top plate by heat conduction, and then transferred to the heat sensitive element. Accordingly, in the heat sensitive element, detection of temperature may be delayed, and the temperature of the cooking container cannot be kept constant precisely.

The present invention is devised to solve the conventional problem, and it is hence an object to present an inductive heating cooking device capable of detecting a temperature of a cooking container (a temperature of bottom of a pan) instantly without delay in detection of temperature, and keeping the temperature of the cooking container constant precisely, and control method thereof, and control program thereof. More specifically, the invention presents an inductive heating cooking device capable of keeping a temperature of a cooking container within a specified range from a predetermined temperature, based on a command received by an input unit, control method thereof, and control program thereof.

Solution to Problem

The inductive heating cooking device of the present invention includes a top plate on which a cooking container is placed, a heating coil to which a high-frequency current is applied to generate an induction magnetic field for heating the cooking container, an input unit configured to receive a command for keeping a temperature of the cooking container at a constant temperature, a control unit configured to control a heating of the cooking container by controlling the high-frequency current to be applied to the heating coil, and an infrared ray sensor configured to detect an infrared ray energy radiated from the cooking container through the top plate. The control unit controls the high-frequency current to be applied to the heating coil based on an output of the infrared ray sensor so as to keep the temperature of the cooking container at a constant temperature according to the command received by the input unit.

Since the temperature of the cooking container is detected directly by using the infrared ray sensor, a temperature of bottom of a pan can be detected instantly, and the temperature of the cooking container can be precisely kept constant (specifically at a temperature within a specified range from the temperature determined according to the command input to the input unit).

The inductive heating cooking device may further include a top plate temperature detecting unit configured to detect a temperature of the top plate, and a top plate temperature correcting unit configured to calculate an infrared ray energy radiated from the top plate using the temperature of the top plate detected by the top plate temperature detecting unit, correct an output of the infrared ray sensor based on the calculated infrared ray energy of the top plate and output the corrected output of the infrared ray sensor to the control unit.

The infrared ray sensor detects the infrared ray energy through the top plate, and hence detects the infrared ray energy radiated from the top plate together with the infrared ray energy radiated from the cooking container. When the temperature of the top plate is low, the infrared ray energy radiated from the top plate is small, but when the temperature of the top plate is high, the infrared ray energy radiated from the top plate is large. Accordingly, when converting the temperature of the cooking container from the infrared ray energy detected by the infrared ray sensor, the infrared ray energy radiated from the top plate may cause an error. Further, since the infrared ray energy radiated from the top plate is proportional to the fourth power of a temperature of the top plate according to the Stefan-Boltzmann Law, and it has a large effect on the value of infrared ray energy detected by the infrared ray sensor. However, according to the above aspect, the temperature of the top plate is detected by the top plate temperature detecting unit, and the infrared ray energy radiated from the top plate is calculated based on the temperature detected by the top plate temperature detecting unit, and the output of the infrared ray sensor is corrected, so that the detection accuracy of the infrared ray sensor can be enhanced.

The inductive heating cooking device may further include an infrared ray sensor temperature detecting unit configured to detect a temperature of the infrared ray sensor, and an infrared ray sensor temperature correcting unit configured to correct an amount of change in an output of the infrared ray sensor based on an amount of change in the temperature of the infrared ray sensor detected by the infrared ray sensor temperature detecting unit, and output the corrected amount of change of the output of the infrared ray sensor to the control unit.

The value of infrared ray energy detected by the infrared ray sensor varies depending on a temperature characteristic of the infrared ray sensor. Hence, by correcting the amount of change in the output of the infrared ray sensor based on the amount of change in the temperature of the infrared ray sensor, the detection accuracy of the infrared ray sensor can be enhanced.

In the inductive heating cooking device, the input unit may include a first temperature switch configured to receive a command for fixing the temperature of the cooking container to a temperature at the time when the first temperature switch is operated, and the control unit may control the high-frequency current to be applied to the heating coil so as to hold the temperature of the cooking container at the time when the first temperature switch is operated.

As a result, the cooking container can be kept at a temperature intended by the user, and the cooking performance and the convenience of the inductive heating cooking device can be improved. For example, when making soup stock from a dried kelp (konbu) or a dried sardine (niboshi), the dried kelp or the dried sardine is put into the cooking container as a cooking material together with water and is heated. In this case, when the water boils, the smell of kelp or sardine is extracted and the taste of the soup stock is spoiled, and therefore it is required to heat and keep the temperature just below the boiling point. For example, when heating a curry or a corn soup as a cooking material, if the heating power is too high, the cooking material may be scorched in the cooking container and the cooking performance is lost, and therefore it is required to heat at a lower than scorching temperature. In such a case, according to the above aspect, if the user manipulates the first temperature switch (operation temperature switch) just before boiling or just before scorching, the heating can be continued while keeping the cooking container at an appropriate temperature.

In the inductive heating cooking device, the input unit may include a second temperature switch configured to receive a command for fixing the temperature of the cooking container to a predetermined temperature, and the control unit may control the high-frequency current to be applied to the heating coil so as to keep the temperature of the cooking container at the predetermined temperature when the second temperature switch is operated.

For example, in the case of a low-heat cooking, in which a meat or a fish is cooked at 60 to 70 degrees C. so that a protein may not be denatured, if the temperature is too high, the protein is denatured, but if the temperature is too low, bacteria grow to promote putrefaction, and therefore it is required to keep the temperature of the cooking container precisely at a constant temperature. According to the above aspect, since the temperature of the cooking container is directly detected by the infrared ray sensor, the temperature of the cooking container can be kept precisely at a temperature within a specified range from the predetermined temperature determined by manipulation of the second temperature switch (predetermined temperature switch), so that the cooking performance of the inductive heating cooking device can be enhanced.

The input unit may also include an adjusting switch configured to adjust a value of the constant temperature.

For example, when the user desires to fix the temperature of the cooking container to a desired temperature and manipulates the operation time switch, but depending on the manipulation timing, a temperature to be held (holding temperature) may be different from the temperature intended by the user. However, by adding an adjusting switch, the user can adjust the holding temperature to a desired temperature. Hence, the cooking performance and the convenience of the inductive heating cooking device can be enhanced.

The control unit may store information on electric power to be applied to the heating coil necessary for keeping the temperature of the cooking container at the constant temperature, and may apply the electric power to the heating coil based on the stored information on the electric power.

As compared with the holding temperature of the cooking container, if the electric power applied to the heating coil is too high, the overshoot increases, but if too low, the holding temperature of the cooking container cannot be maintained, or it takes a long time until reaching the holding temperature. However, according to the above aspect, the overshoot can be decreased, and it is possible to select an optimum electric power for maintaining the temperature of the cooking container constantly (at a temperature within a specified range from the holding temperature), and the cooking performance of the inductive heating cooking device can be enhanced.

The inductive heating cooking device may further include a thermal capacity calculating unit configured to calculate a thermal capacity of a cooking material in the cooking container and the cooking container, and the control unit may store information on electric power to be applied to the heating coil necessary for keeping the temperature of the cooking container at the constant temperature based on the thermal capacity of the cooking material and the cooking container calculated by the thermal capacity calculating unit, and may apply an electric power to the heating coil based on the stored information on the electric power.

If the electric power applied to the heating coil is too high as compared with the thermal capacity of the cooking material and the cooking container, the overshoot increases, but if too low, the holding temperature of the cooking container cannot be maintained or it takes a long time until reaching the holding temperature, and various problems may occur. However, according to the above aspect, the overshoot can be decreased and it is possible to select an optimum electric power for maintaining the temperature of the cooking container constantly (at a temperature within a specified range from the holding temperature), and therefore the cooking performance of the inductive heating cooking device can be enhanced.

Besides, the input unit may also include a third temperature switch configured to receive a command for keeping a temperature of a cooking material in the cooking container at the constant temperature, and the control unit may have a cooling time determination unit configured to determine a cooling time for stopping the heating, depending on the temperature of the cooking container when the third temperature switch is operated. When the third temperature switch is operated, the control unit may stop the heating during the cooling time determined by the cooling time determination unit and may control the high-frequency current to be applied to the heating coil by reference to an output value of the infrared ray sensor after a lapse of the cooling time.

For example, in the case of grilling or frying such as grilling a steak or frying vegetables, "the temperature of the cooking container" is an important element to be managed, but in the case of boiling or stewing", the temperature of the cooking material" is more important to be managed than the temperature of the cooking container. On the other hand, when the cooking container is heated at a high heating power, the difference in the temperature between the cooking container and the cooking material is increased. Accordingly, while stewing at a high heating power, if the temperature of the cooking container is controlled to be kept constant in order to keep the temperature of the cooking material constant, the temperature of the cooking material gradually approaches the temperature of the cooking container. As a result, the temperature of the cooking material may not be kept constant. However, according to the above aspect, by providing a cooling time (heating stopping time) for the cooking container, the temperature of the cooking container is lowered, and the difference in the temperature of the cooking container and the cooking material is absorbed or disappears, and the temperature of the cooking material will not rise up to the temperature of the cooking container. Hence, by controlling the temperature of the cooking container at a temperature within a specific range from the temperature after a lapse of the cooling time, the temperature of the cooking material may be kept within a specific range from the temperature when accepting the manipulation. For example, in the case of cooking meat, by stewing the meat at about 85 deg. C., the meat can be made to be juicy and tender. In the case of cooking vegetables, by stewing vegetables at about 98 deg. C., vegetables can be cooked appropriately without overcooking while the seasoning penetrates the vegetables sufficiently.

A method of the present invention is a method of controlling an operation of an inductive heating cooking device having a top plate on which a cooking container is placed, and a heating coil to which a high-frequency current is applied to generate an induction magnetic field for heating the cooking container. The method includes applying a high-frequency current to the heating coil to generate an induction magnetic field for heating the cooking container placed on the top plate, receiving a command for keeping a temperature of the cooking container at a constant temperature, detecting an infrared ray energy radiated from the cooking container through the top plate, and controlling a heating of the cooking container by controlling the high-frequency current to be applied to the heating coil based on the detected infrared ray energy so as to keep the temperature of the cooking container at the constant temperature, according to the received command.

A program of the present invention is a program for controlling an operation of an inductive heating cooking device having a top plate on which a cooking container is placed and a heating coil to which a high-frequency current is applied to generate an induction magnetic field for heating the cooking container. The program causes a computer to execute the functions of applying a high-frequency current to the heating coil to generate an induction magnetic field for heating the cooking container placed on the top plate, receiving a command for keeping a temperature of the cooking container at a constant temperature, detecting an infrared ray energy radiated from the cooking container through the top plate, and controlling a heating of the cooking container by controlling the high-frequency current to be applied to the heating coil based on the detected infrared ray energy so as to keep the temperature of the cooking container at the constant temperature, according to the received command.

The program can realize easily at least a part of the inductive heating cooking device by cooperating the hard resources such the electric and information appliances, computer, and servers. Besides, by recording the program in a storage medium or distributing the program by using communication lines, the program may be distributed, updated, or installed easily.

Advantageous Effects of Invention

According to the present invention, by detecting directly the temperature of the cooking container by the infrared ray sensor, the temperature of bottom of the pan can be detected instantly without causing delay in temperature detection and the temperature of the cooking container can be kept precisely. For example, according to the invention, the temperature of the cooking container can be kept within a specified range from a predetermined temperature determined based on the command received by the input unit. Hence, the cooking performance and convenience of the inductive heating cooking device may be enhanced.

BRIEF DESCRIPTION OF THE DRAWINGS

FIG. 13 is a diagram showing an example of a table of cooling time suited to a temperature of the cooking container in embodiment 3 of the present invention.

FIG. 14A is a graph of temperature of the cooking container and the cooking material without provision of the cooling time, and FIG. 14B is a graph of temperature of the cooking container and the cooking material with provision of the cooling time in embodiment 3 of the present invention.

DETAILED DESCRIPTION OF THE PREFERRED EMBODIMENTS

Embodiments of the present invention are specifically described below while referring to the accompanying drawings.

Embodiment 1

The inductive heating cooking device in embodiment 1 of the present invention has a heat retaining function for keeping the temperature of a cooking container constant. In particular, the inductive heating cooking device in embodiment 1 of the present invention detects a temperature of bottom of a pan (pan bottom temperature) instantly by using an infrared ray sensor to be capable of keeping the temperature of a cooking container precisely at a constant temperature without causing delay in temperature detection. In the specification, the "constant temperature" refers to a temperature within a specified range (for example, ±5 deg. C.) from a temperature (hereinafter called a holding temperature) determined based on a command received by the input unit. For example, when the holding temperature is 60 deg. C., the constant temperature is any temperature in a range of 55 deg. C. to 65 deg. C. The word of "constant" means to keep the actual temperature of the cooking container at the constant temperature by controlling to keep the temperature of the cooking container at the holding temperature.

1.1 Configuration of Inductive Heating Cooking Device

Figure 1:
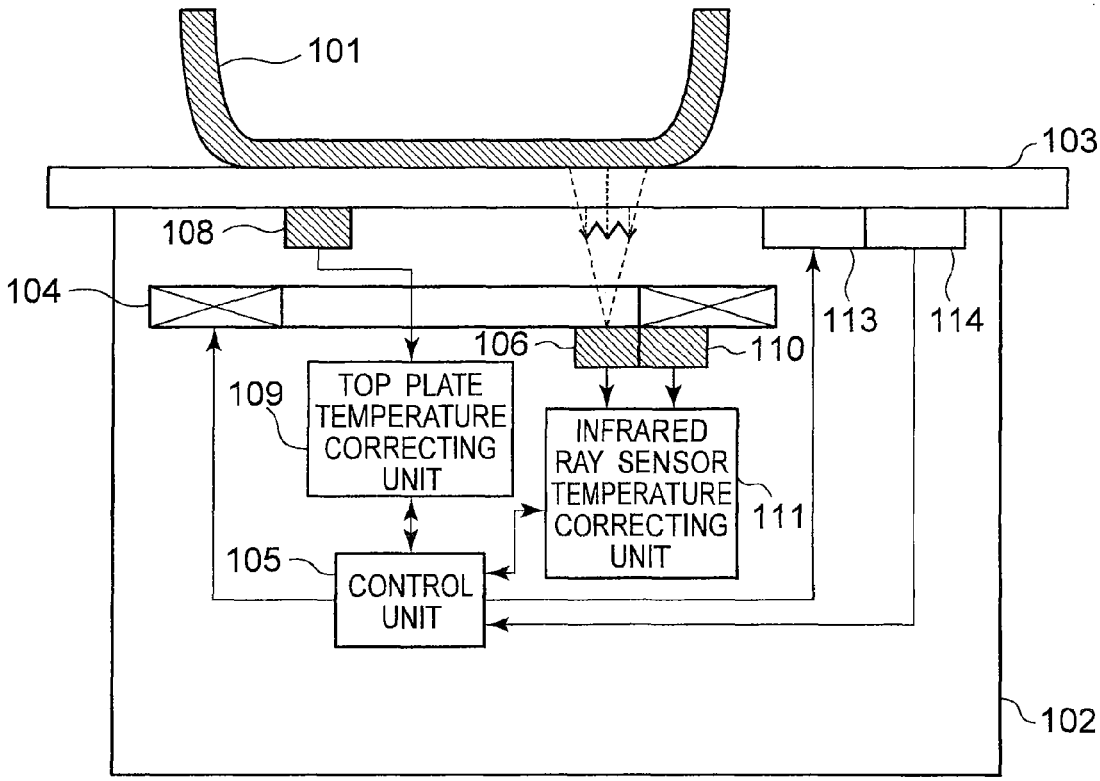
FIG. 1 is a configuration diagram showing schematically an inductive heating cooking device in embodiment 1 of the present invention.

FIG. 1 is a configuration diagram schematically showing an inductive heating cooking device in embodiment 1 of the present invention. The inductive heating cooking device of the embodiment inductively heats a cooking container 101 (for example, a frying pan) in which an object to be heated (cooking material) is contained. The inductive heating cooking device of the embodiment includes an outer case 102, a top plate 103 provided on the top of the outer case 102 on which the cooking container 101 is placed, a heating coil 104 to which a high-frequency current is applied to generate an induction magnetic field for heating the cooking container 101, and a control unit 105 configured to control a heating of the cooking container 101 by controlling the high-frequency current to be applied to the heating coil 104. In this embodiment, the outer case 102 is a metal case, and the top plate 103 is a glass plate. The control unit 105 is realized by a microcomputer.

The inductive heating cooking device of the embodiment further includes an infrared ray sensor 106 configured to detect an infrared ray energy radiated from the cooking container 101 through the top plate 103, a top plate temperature detecting unit 108 configured to detect the temperature of the top plate 103, a top plate temperature correcting unit 109 configured to calculate the infrared ray energy radiated by the top plate 103 based on the temperature of the top plate 103 and correct an value of the infrared ray energy output by the infrared ray sensor 106, an infrared ray sensor temperature detecting unit 110 configured to detect the temperature of the infrared ray sensor 106, and an infrared ray sensor temperature correcting unit 111 configured to correct an value of the infrared ray energy or an amount of change in the value of the infrared ray energy output by the infrared ray sensor 106 based on the temperature of the infrared ray sensor 106 or an amount of change in the temperature of the infrared ray sensor 106. In this embodiment, the infrared ray sensor 106 is a photodiode, and the top plate temperature detecting unit 108 and the infrared ray sensor temperature detecting unit 110 are thermistors for detecting the temperature by heat conduction. The top plate temperature correcting unit 109 and the infrared ray sensor temperature correcting unit 111 are realized by a microcomputer.

The inductive heating cooking device of the embodiment further includes an informing unit 113 configured to inform the user, and an input unit 114 configured to receive an input from the user. In the embodiment, the informing unit 113 is a liquid crystal display (LCD), which displays the temperature or the heating power of the cooking container. The input unit 114 is an electrostatic capacitance type switch.

The control unit 105 controls the high-frequency current to be applied to the heating coil 104 based on the output of the infrared ray sensor 106, and thereby controls the temperature of the cooking container 101 to keep a temperature within a specified range (for example, ±5 deg. C.) from the temperature specified in the input unit 114 (holding temperature). In the embodiment, the control unit 105 stores information on electric power to be applied to the heating coil 104 necessary for keeping the temperature within a specified range from the temperature specified in the input unit 114, and applies the electric power to the heating coil 104 based on the stored information on electric power.

Figure 2:
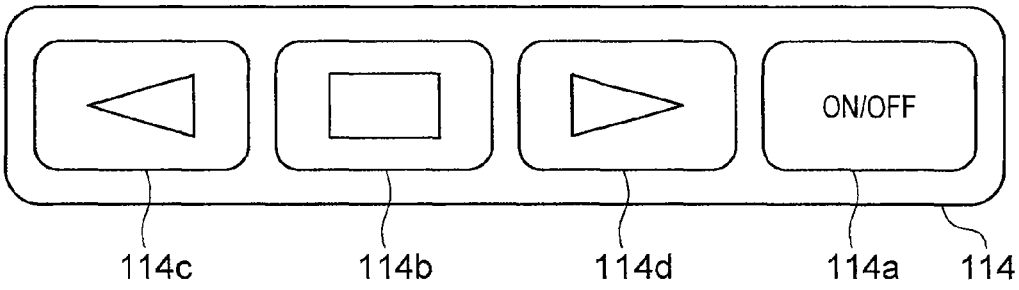
FIG. 2 is a configuration diagram of an input unit in embodiment 1 of the present invention.

FIG. 2 shows a configuration of the input unit 114 in embodiment 1 of the present invention. The input unit 114 includes an on/off switch 114*a* configured to receive an input instruction of start or stop of heating of the cooking container 101, an operation temperature switch 114*b* configured to receive an input instruction for keeping the temperature of the cooking container 101 at a temperature (holding temperature) of the cooking container 101 at the time of reception of operation, the first adjusting switch 114*c* configured to receive an input instruction for lowering the holding temperature, and the second adjusting switch 114*d* configured to receive an input instruction for raising the holding temperature.

When the operation temperature switch 114*b* receives a user's operation, the control unit 105 controls to keep the temperature of the cooking container 101 at a temperature within a specified range from the temperature (holding temperature) at the time when the operation temperature switch 114*b* is operated.

When the first adjusting switch 114*c* is operated, the control unit 105 controls to decrease the holding temperature. When the second adjusting switch 114*d* is operated, the control unit 105 controls to raise the holding temperature.

1.2 Operation of Inductive Heating Cooking Device

Figure 3:
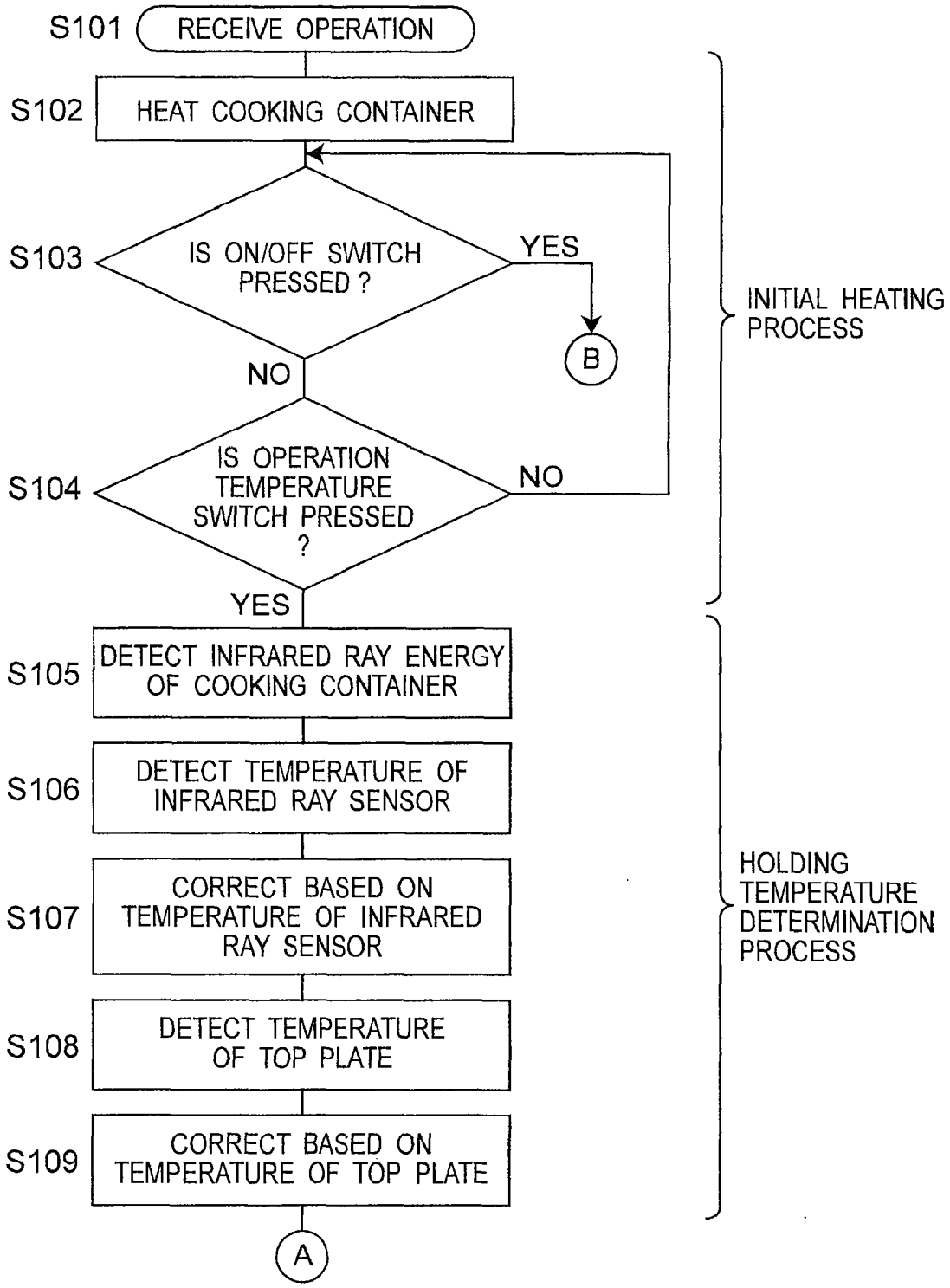
FIG. 3 is a flowchart showing an operation sequence in embodiment 1 of the present invention.
Figure 4:
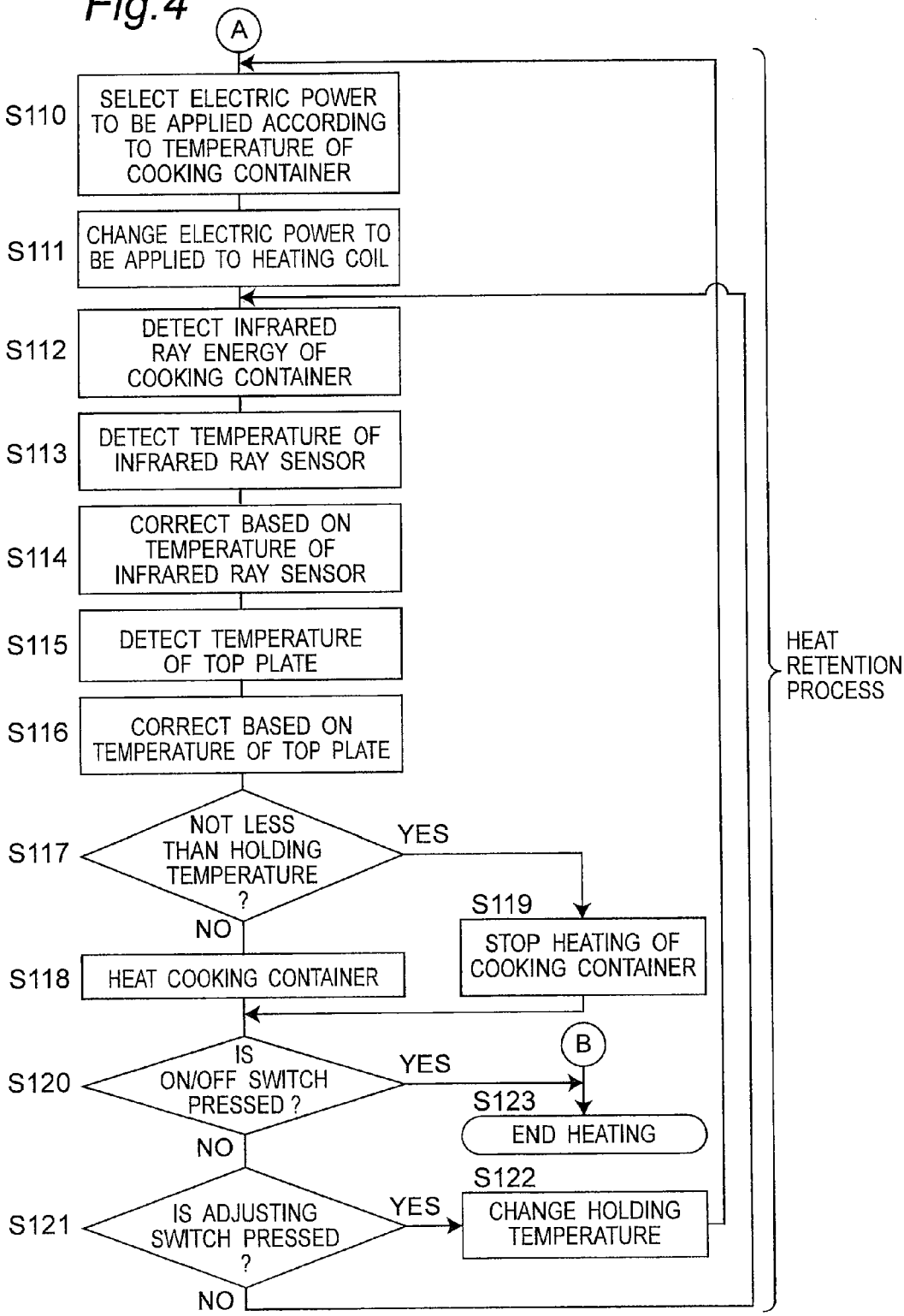
FIG. 4 is a flowchart in succession to FIG. 3.

Referring now to FIG. 3 and FIG. 4, the following is an explanation of control by the control unit 105, the infrared ray sensor temperature correcting unit 111, and the top plate temperature correcting unit 109 of the embodiment, when the operation temperature switch 114*b* is operated by the user. FIG. 3 and FIG. 4 are flowcharts showing the operation sequence in embodiment 1 of the present invention. FIG. 4 shows a flow subsequent to FIG. 3. In the embodiment, until the operation temperature switch 114*b* is pressed by the user, the control unit 105 continues to control the heating coil 104 by the initial electric power (S101 to S104). When the operation temperature switch 114*b* is pressed down, the control unit 105 determines the temperature when the operation temperature switch 114*b* is pressed as the holding temperature (S105 to S109). After the operation temperature switch 114*b* is pressed down, the control unit 105 controls the heating coil so as to maintain the determined holding temperature (S110 to S123). Hereinafter, the operation of the embodiment is specifically described below.

The user presses the on/off switch 114*a*, and the control unit 105 receives the user's operation of the on/off switch 114*a* (S101), then the control unit 105 applies a predetermined electric power to the heating coil 104 to start heating of the cooking container 101 (S102). Herein, the predetermined electric power is an initial electric power upon start of heating, and it is preliminarily stored in the control unit 105.

The control unit 105 subsequently judges whether or not the on/off switch 114*a* is pressed again (S103). When the on/off switch 114*a* is pressed (Yes at S103), the control unit 105 stops applying the electric power to the heating coil 104, and terminates heating of the cooking container 101 (S123).

When the on/off switch 114*a* is not pressed (No at S103), the control unit 105 judges whether or not the operation temperature switch 114*b* is pressed (S104). If not pressed (No at S104), going back to S103, heating is continued at the initial electric power until the on/off switch 114*a* or the operation temperature switch 114*b* is pressed.

When the operation temperature switch 114*b* is pressed (Yes at S104), the control unit 105 determines the temperature of the cooking container 101 when the operation temperature switch 114*b* is pressed (S105 to S109), and determines an amount of the electric power to be applied to the heating coil 104 based on the determined temperature (S110 to S111). The control unit 105 first detects the infrared ray energy radiated from the cooking container 101, and detects the temperature of the cooking container 101 when the operation temperature switch 114*b* is pressed (S105 to S109) by correcting a value of the detected infrared ray energy based on the outputs of the top plate temperature detecting unit 108 and the infrared ray sensor temperature detecting unit 110 in order to calculate the temperature of the cooking container 101 more accurately.

More specifically, first of all, the control unit 105 allow the infrared ray sensor 106 to detect the infrared ray energy, and operates the infrared ray sensor temperature correcting unit 111 to correct the value of the infrared ray energy detected by the infrared ray sensor 106 based on the temperature of the infrared ray sensor 106.

The infrared ray sensor temperature correcting unit 111 operates the infrared ray sensor 106 to detect the infrared ray energy radiated from the cooking container 101 (S105). When a photodiode is used for the infrared ray sensor 106, a current flows into the photodiode by a photovoltaic effect. By converting this current into a voltage and amplifying the converted voltage by an operational amplifier, the infrared ray energy radiated from the cooking container 101 can be detected as a voltage value.

Next, the infrared ray sensor temperature correcting unit 111 operates the infrared ray sensor temperature detecting unit 110 to detect the temperature of the infrared ray sensor 106 (S106). The infrared ray sensor temperature correcting unit 111 preliminarily stores information on temperature characteristics of the infrared ray sensor 106 (for example, information about the value of infrared ray energy depending on the temperature of the infrared ray sensor 106, or information about an amount of change in the infrared ray energy depending on the temperature change of the infrared ray sensor 106). The infrared ray sensor temperature correcting unit 111 corrects the value of infrared ray energy detected at S105, based on the temperature of the infrared ray sensor 106 detected at S106 and the stored information on temperature characteristic of the infrared ray sensor 106, and transmits the corrected value of infrared ray energy to the control unit 105 (S107). At S106, alternatively, by detecting an amount of change in the temperature of the infrared ray sensor 106 within a predetermined time, the amount of change in the value of the infrared ray energy detected at S105 may be corrected based on the amount of change in the temperature of the infrared ray sensor 106 and the information on the temperature characteristic of the infrared ray sensor 106, and the corrected value of infrared ray energy may be transmitted to the control unit 105.

After receiving the corrected value of infrared ray energy from the infrared ray sensor temperature correcting unit 111, the control unit 105 operates the top plate temperature correcting unit 109 in order to correct the value of infrared ray energy detected by the infrared ray sensor 106 based on the temperature of the top plate 103, and transmits the value of infrared ray energy received at S107 to the top plate temperature correcting unit 109.

The top plate temperature correcting unit 109 operates the top plate temperature detecting unit 108 to detect the temperature of the top plate 103 (S108). The top plate temperature correcting unit 109 preliminarily stores information on infrared ray energy radiated from the top plate 103 (for example, the corresponding information on temperature of the top plate 103 and the value of infrared ray energy of the top plate 103). The top plate temperature correcting unit 109 calculates the infrared ray energy radiated by the top plate 103 based on the detected temperature of the top plate 103 and the stored information on the infrared ray energy, corrects the value of infrared ray energy received from the control unit 105 at S107 based on the calculated value of infrared ray energy of the top plate 103, and thereby transmits the corrected value of infrared ray energy to the control unit 105 (S109). The value of infrared ray energy corrected at S109 is a true value of infrared ray energy radiated by the cooking container 101 when the operation temperature switch 114*b* is pressed at S104.

In this manner, the value of infrared ray energy radiated from the cooking container 101 detected by the infrared ray sensor 106 is corrected based on the temperature of the infrared ray sensor 106 detected by the infrared ray sensor temperature detecting unit 110 and the temperature of the top plate 103 detected by the top plate temperature detecting unit 108. The control unit 105 converts the corrected value of infrared ray energy received at S109 into a temperature (holding temperature) of the cooking container 101.

The control unit 105 selects, from the stored information on electric power, the electric power to be applied to the heating coil 104 which is necessary for maintaining the temperature of the cooking container 101 at a temperature within a specified range from the converted temperature (that is, the temperature when the operation temperature switch 114*b* is operated)(S110). The control unit 105 changes the electric power to be applied to the heating coil 106 to the selected electric power from the initial electric power (S111). Thereafter, the control unit 105 changes over between application of electric power to the heating coil 104 and stopping application of electric power, so as to keep the temperature of the cooking container 101 at a temperature within a specified range from the temperature (holding temperature) of the cooking container 101 when the operation temperature switch 114*b* is operated. (S112 to S123).

More specifically, first of all, in order to detect the present temperature of the cooking container 101 after change of electric power, the control unit 105 detects and corrects again the infrared ray energy radiated from the cooking container 101 after change of electric power (S112 to S116). The operation from S112 to S116 is the same as the operation from S105 to S109, and the detailed description is omitted.

The control unit 105 compares the value of infrared ray energy (present value) at S116 with the value of infrared ray energy (reference value) at S109, and judges whether or not the temperature of the cooking container 101 is not less than the holding temperature (S117).

When the temperature of the cooking container 101 is less than the holding temperature (No at S117), the control unit 105 continues to apply the electric power to the heating coil 104, and thereby continues to heat the cooking container 101 (S118). When the temperature of the cooking container 101 is not less than the holding temperature (Yes at S117), the control unit 105 stops applying the electric power to the heating coil 104, and thereby stops heating of the cooking container 101 (S119). As a result, the temperature of the cooking container 101 can be maintained at a temperature within a specified range from the temperature (holding temperature) when the operation temperature switch 114*b* is operated, even if an overshooting of heating occurs.

The control unit 105 judges whether or not the on/off switch 114*a* is pressed again (S120). If the on/off switch 114*a* is not pressed (No at S120), the control unit 105 judges whether or not the first adjusting switch 114*c* or the second adjusting switch 114*d* is pressed (S121).

If the first adjusting switch 114*c* and the second adjusting switch 114*d* are not pressed (No at S121), going back to S112, the control unit 105 repeats continuing of heating and stopping of heating based on the comparison between the present temperature and the holding temperature until either one of the on/off switch 114*a*, the first adjusting switch 114*c* and the second adjusting switch 114*d* is pressed, and thereby maintains the temperature of the cooking container 101 at the holding temperature when the operation temperature switch 114*b* is operated.

When the first adjusting switch 114*c* is pressed (Yes at S121), the control unit 105 controls to lower the holding temperature (for example, lower by 5 deg. C.). When the second adjusting switch 114*d* is pressed, the control unit 105 controls to raise the holding temperature (for example, raise by 5 deg. C.). When the first adjusting switch 114*c* or the second adjusting switch 114*d* is pressed, the control unit 105 returns to S110 and determines the electric power again based on the holding temperature after change.

When the on/off switch 114*a* is pressed at S120 (Yes at S120), the control unit 105 stops applying of electric power to the heating coil 104 and terminates heating of the cooking container 101 (S123).

1.3 Summary

As explained herein, the inductive heating cooking device of the embodiment detects the infrared ray energy radiated from the cooking container 101 by using the infrared ray sensor 106 and detects the temperature of the cooking container based on the detected infrared ray energy so that the temperature of bottom of the pan can be detected instantly without causing delay in temperature detection. Hence, the temperature of the cooking container 101 can be kept precisely at the holding temperature. More specifically, the temperature of the cooking container 101 can kept precisely at a temperature within a specified range from the temperature when the operation temperature switch 114*b* is operated.

Further, according to the embodiment, since the value of infrared ray energy detected by the infrared ray sensor 106 is corrected by the temperature of the top plate 103 and the temperature of the infrared ray sensor 106, the temperature of the cooking container can be calculated more accurately. That is, the temperature of the cooking container can be detected without being influenced by the infrared ray energy radiated from the top plate 103. Moreover, based on the temperature characteristic of the infrared ray sensor 106, the output of the infrared ray sensor 106 can be corrected so that the detection accuracy of the infrared ray sensor 106 may be enhanced.

Embodiment 2

The inductive heating cooking device in embodiment 2 of the present invention is described below while referring to the accompanying drawings. The inductive heating cooking device in embodiment 1 applies, to the heating coil 104, the electric power depending on the temperature of the cooking container when the operation temperature switch 114*b* is pressed and controls to keep, constant, the temperature of the cooking container when the operation temperature switch 114*b* is pressed. On the other hand, the inductive heating cooking device in embodiment 2 has a switch for setting the holding temperature and applies, to the heating coil 104, the electric power determined based on the thermal capacity of the cooking material in the cooking container 101 and the cooking container 101, and thereby controls the temperature of the cooking container at the set holding temperature.

2.1 Configuration of Inductive Heating Cooking Device

Figure 5:
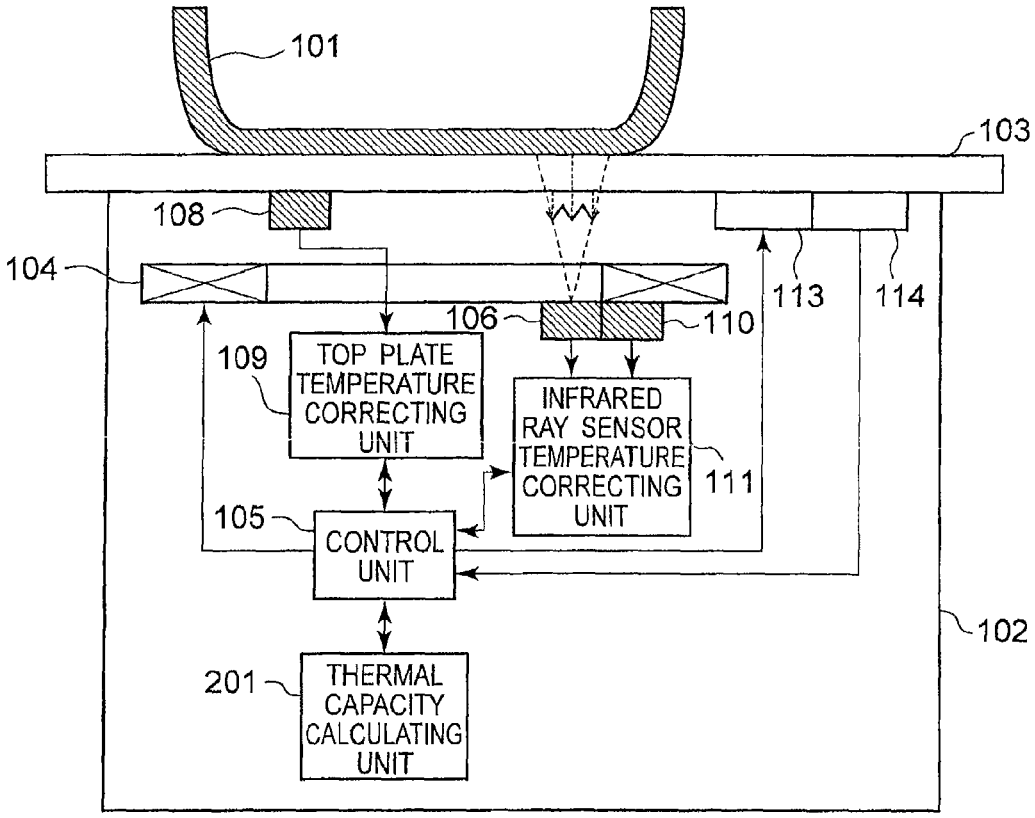
FIG. 5 is a configuration diagram showing schematically an inductive heating cooking device in embodiment 2 of the present invention.

FIG. 5 is a configuration diagram schematically showing the inductive heating cooking device in embodiment 2 of the present invention. The inductive heating cooking device of the embodiment has a thermal capacity calculating unit 201 configured to calculate a thermal capacity of the cooking material in the cooking container 101 and the cooking container 101. In the embodiment, the thermal capacity calculating unit 201 is realized by a microcomputer. The control unit 105 stores information on the electric power to be applied to the heating coil necessary for keeping at a temperature within a specified range from a temperature (holding temperature) determined by predetermined temperature switches (see FIG. 6) based on the thermal capacities of the cooking material and the cooking container 101 calculated in the thermal capacity calculating unit 201, and applies the electric power to the heating coil 104 based on the stored information on electric power. In the configuration of the embodiment, the thermal capacity calculating unit 201 is added. Other configurations are the same as those in embodiment 1, and therefore the detailed description is omitted.

Figure 6:
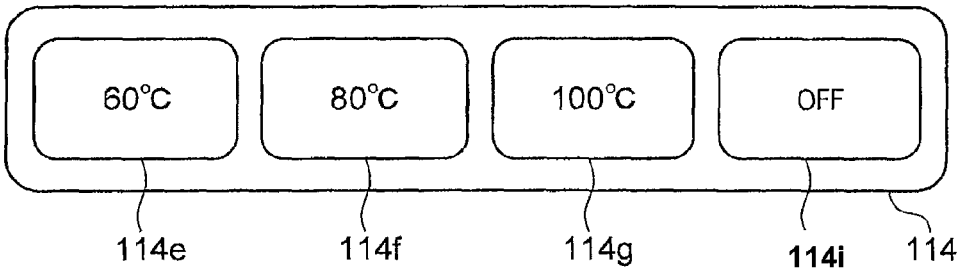
FIG. 6 is a configuration diagram of an input unit in embodiment 2 of the present invention.

FIG. 6 is a configuration diagram of the input unit 114 in embodiment 2 of the present invention. In this embodiment, the input unit 114 includes the first predetermined temperature switch 114*e* configured to receive an instruction to keep the temperature of the cooking container 101 at 60° C., the second predetermined temperature switch 114*f* configured to receive an instruction to keep the temperature of the cooking container 101 at 80° C., the third predetermined temperature switch 114*g* configured to receive an instruction to keep the temperature of the cooking container 101 at 100° C., and an off-switch 114*i* configured to receive an instruction to stop heating of the cooking container 101.

2.2 Operation of Inductive Heating Cooking Device

Figure 7:
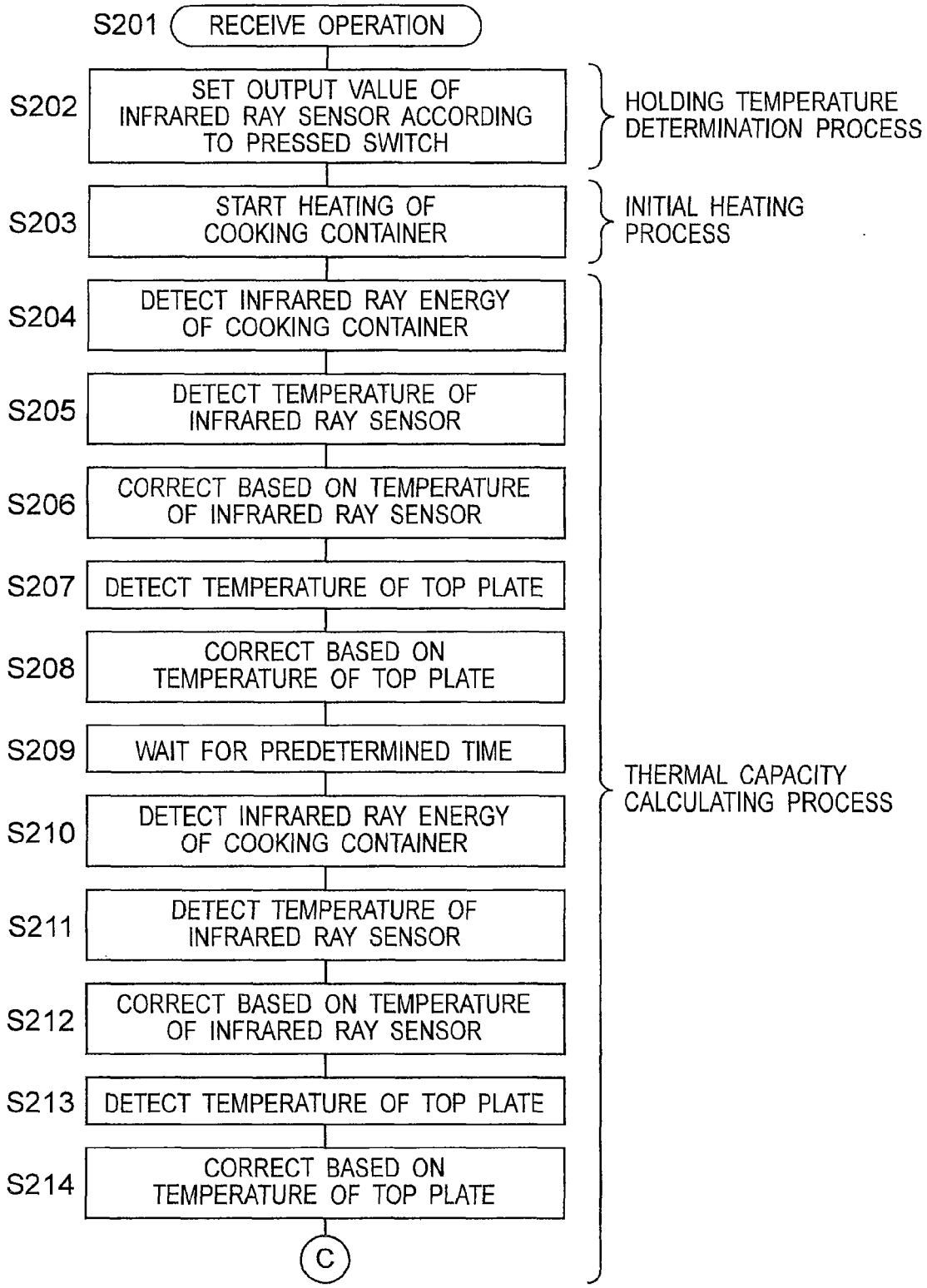
FIG. 7 is a flowchart showing an operation sequence in embodiment 2 of the present invention.
Figure 8:
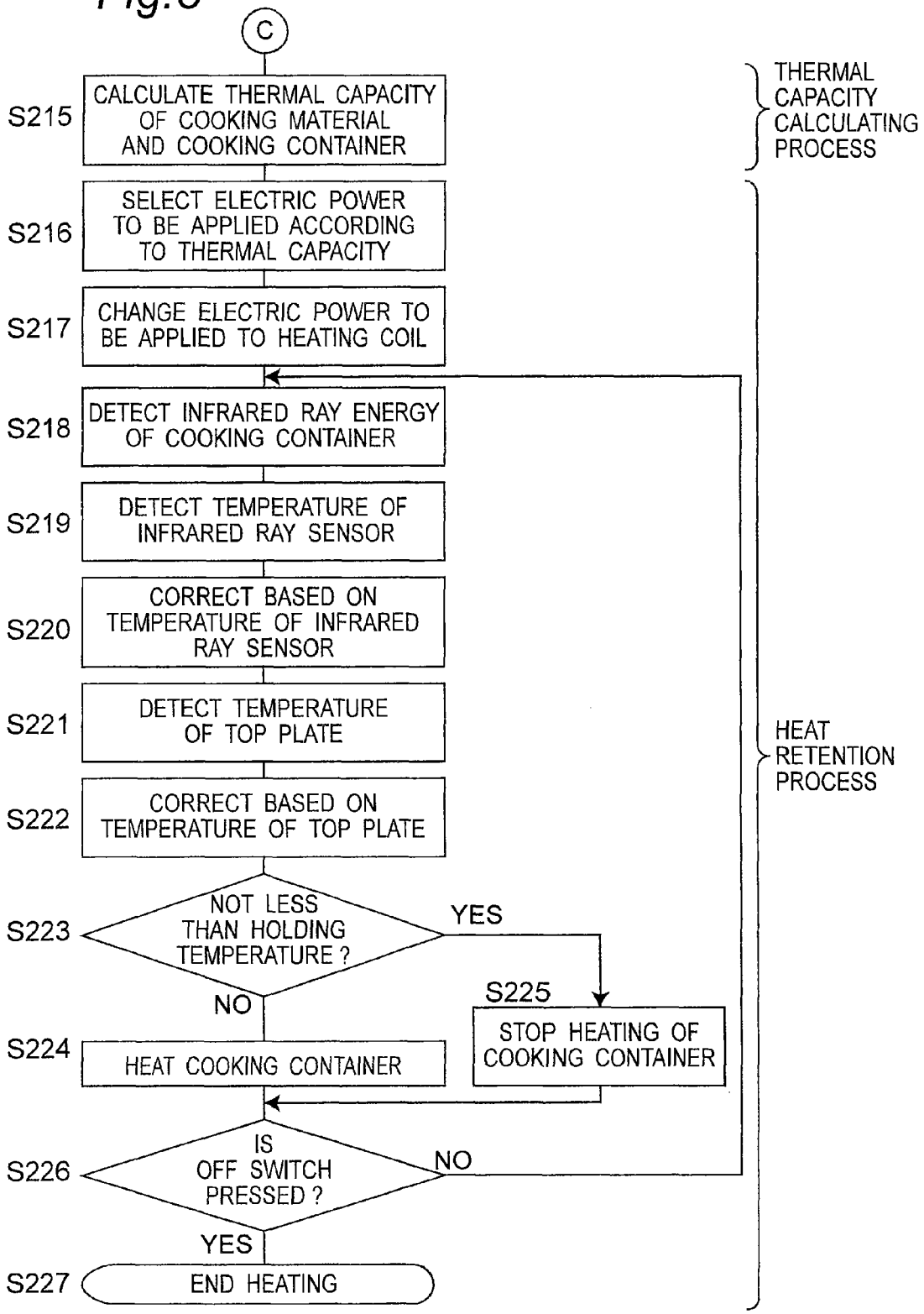
FIG. 8 is a flowchart in succession to FIG. 7.

Referring to FIG. 7 and FIG. 8, the operations of the control unit 105, the infrared ray sensor temperature correcting unit 111, the top plate temperature correcting unit 109, and the thermal capacity calculating unit 201 of the embodiment is explained in relation to operations of the first predetermined temperature switch 114*e*, the second predetermined temperature switch 114*f*, and the third predetermined temperature switch 114*g*. FIG. 7 and FIG. 8 are flowcharts showing the operation sequence in embodiment 2 of the present invention. FIG. 8 shows a flow subsequent to FIG. 7. In this embodiment, the holding temperature is determined according to the pressed switch (S201 to S202), the heating coil 104 is controlled at a predetermined electric power, and the thermal capacities of the cooking material and the cooking container 101 are calculated (S203 and S204 to S215, and the electric power determined based on the calculated thermal capacities is applied to the heating coil 104, and thereby the temperature of the cooking container 101 is controlled to be maintained at the holding temperature (S216 to S227). The operation of the embodiment is specifically described below.

When the user presses any one of the first predetermined temperature switch 114*e*, the second predetermined temperature switch 114*f*, and the third predetermined temperature switch 114*g* and the control unit 105 receives an instruction depending on the pressed switch (S201), the control unit 105 determines the value of infrared ray energy output by the infrared ray sensor 106 for keeping the temperature of the cooking container 101 at a temperature within a specified range (for example, within ±5 deg. C.) from the temperature (holding temperature) according to the pressed switch (S202). Herein, the holding temperature according to the pressed switch is 60 deg. C. when the first predetermined temperature switch 114*e* is pressed, and is 80 deg. C. when the second predetermined temperature switch 114*f* is pressed, and is 100 deg. C. when the third predetermined temperature switch 114*g* is pressed. The control unit 105 preliminarily stores the values of infrared ray energy output by the infrared ray sensor 106, necessary for keeping the temperature of the cooking container 101 at a temperature within a specified range from the holding temperature.

Next, to determine the electric power to be applied to the heating coil 104 based on the thermal capacity of the cooking material and the cooking container 101, the control unit 105 starts heating at specified electric power (S203), and calculates the thermal capacity of the cooking material and the cooking container 101 (S203 to S215).

Specifically, the control unit 105 first applies a predetermined electric power to the heating coil 104 (S203).

Afterward, the control unit 105 operates the infrared ray sensor 106 to detect and correct the infrared ray energy radiation from the cooking container 101 right after starting of heating (S204 to S208). The process from S204 to S208 is the same as that from S105 to S109 in FIG. 3, and the detailed description is omitted.

The control unit 105 continues to heat the cooking container 101, and waits for a predetermined time (for example, 10 seconds) (S209). Then, the control unit 105 detects and corrects the infrared ray energy radiation from the cooking container 101 again (S210 to S214). The process from S210 to S214 is the same as that from S105 to S109 in FIG. 3, and the detailed description is omitted.

The thermal capacity calculating unit 201 calculates the thermal capacity of the cooking material in the cooking container 101 and the cooking container 101 (S215). The thermal capacity of the cooking material in the cooking container 101 and the cooking container 101 can be calculated by using an amount of change in the temperature of the cooking container 101 when the cooking container 101 is heated for a predetermined time, that is, an amount of change in the value of infrared ray energy radiated from the heating container 101. The thermal capacity calculating unit 201 compares the value of infrared ray energy (the value of infrared ray energy after correction at S208) upon start of heating with the value of infrared ray energy (the value of infrared ray energy after correction at S214) upon a lapse of predetermined time from the start of heating, and calculates the thermal capacity of the coking material in the cooking container 101 and the cooking container 101 based on the amount of change in the value of infrared ray energy. Herein, in a case where the predetermined power to be applied at S203 is a higher power, the difference in the temperatures due to thermal capacity is made clearer, and the calculation accuracy of thermal capacity is enhanced.

The control unit 105 preliminarily stores information on the electric power to be applied to the heating coil, necessary for keeping the cooking container 101 at a temperature within a specified range from the temperature designated by the predetermined temperature switch, based on the thermal capacity of the cooking material and the cooking container 101 calculated in the thermal capacity calculating unit 201. The control unit 105 selects an optimum electric power from the stored information on electric power based on the thermal capacity calculated at S215 (S216). The control unit 105 changes the electric power being applied to the heating coil 104 to the selected electric power (S217).

After change of the electric power, the control unit 105 performs a control to maintain the temperature of the cooking container 101 at a holding temperature determined by pressing the predetermined temperature switch (S218 to S227). Specifically, first, the control unit 105 detects and corrects again the infrared ray energy radiated from the cooking container 101 (S218 to S222). The process from S218 to S222 is the same as that from S105 to S109 in FIG. 3, and the detailed description is omitted.

Then, the control unit 105 compares the present the value of infrared ray energy (the value of infrared ray energy at S222) with the value of infrared ray. energy necessary for maintaining the temperature of the cooking container 101 at the holding temperature (the value of infrared ray energy at S202), and determines whether or not the temperature of the cooking container 101 is not less than the holding temperature (S223).

If the temperature of the cooking container 101 is less than the holding temperature (No at S223), the control unit 105 continues to apply the electric power to the heating coil 104 (S224), and heating of the cooking container 101 is continued. If the temperature of the cooking container 101 is not less than the holding temperature (Yes at S223), the control unit 105 stops applying the electric power to the heating coil 104 (S225), and heating of the cooking container 101 is stopped. In this manner, the temperature of the cooking container 101 can be maintained at a temperature within a specified range from the holding temperature designated by the predetermined temperature switches 114*e*, 114*f*, and 114*g*, even when overshooting of heating occurs.

The control unit 105 judges whether or not the off-switch 114*h* is pressed (S226). If the off-switch 114*h* is not pressed (No at S226), the process returns to S218. Until the off-switch 114*i* is pressed, the control unit 105 continues to detect and correct the infrared ray energy radiated from the heating container 101, and controls the heating coil 104 to keep the temperature of the cooking container 101 at the holding temperature, thereby heating the cooking container 101.

When the off-switch 114*i* is pressed (Yes at S226), the control unit 105 stops applying the electric power to the heating coil 104, and terminates heating of the cooking container 101 (S227).

2.3 Summary

As described herein, since the inductive heating cooking device of the embodiment detects the temperature of the cooking container based on the infrared ray energy radiated from the cooking container 101, the temperature of the bottom of the pan can be detected instantly without delay in temperature detection. Hence, the temperature of the cooking container 101 can be kept precisely. More specifically, the temperature of the cooking container 101 can kept precisely at a temperature within a specified range from the temperature designated by the predetermined temperature switches 114*e*, 114*f*, and 114*g*.

Further, although, according to the embodiment, the thermal capacity of the cooking material and the cooking container 101 is calculated based on the amount of change in the infrared ray energy of the cooking container 101 before and after heating for a predetermined time, the calculation of the thermal capacity is not limited to this method. For example, the thermal capacity calculating unit 201 may detect the infrared ray energy of the cooking container 101 after heating for a predetermined time, and then detect the infrared ray energy of the cooking container 101 after cooling for a predetermined time, so that the thermal capacity of the cooking material in the cooking container 101 and the cooking container 101 may be calculated based on an amount of change between the infrared ray energy detected after heating and the infrared ray energy detected after cooling. In this case, the same effect as that in the embodiment will be obtained.

Embodiment 3

The inductive heating cooking device in embodiment 3 of the present invention is described below while referring to the accompanying drawings. The inductive heating cooking device in embodiment 1 and embodiment 2 is provided with a function of keeping the "temperature of the cooking container" constant. On the other hand, the inductive heating cooking device in embodiment 3 is provided with a function of keeping the "temperature of the cooking material" in the cooking container 101 constant.

3.1 Configuration of Inductive Heating Cooking Device

Figure 9:
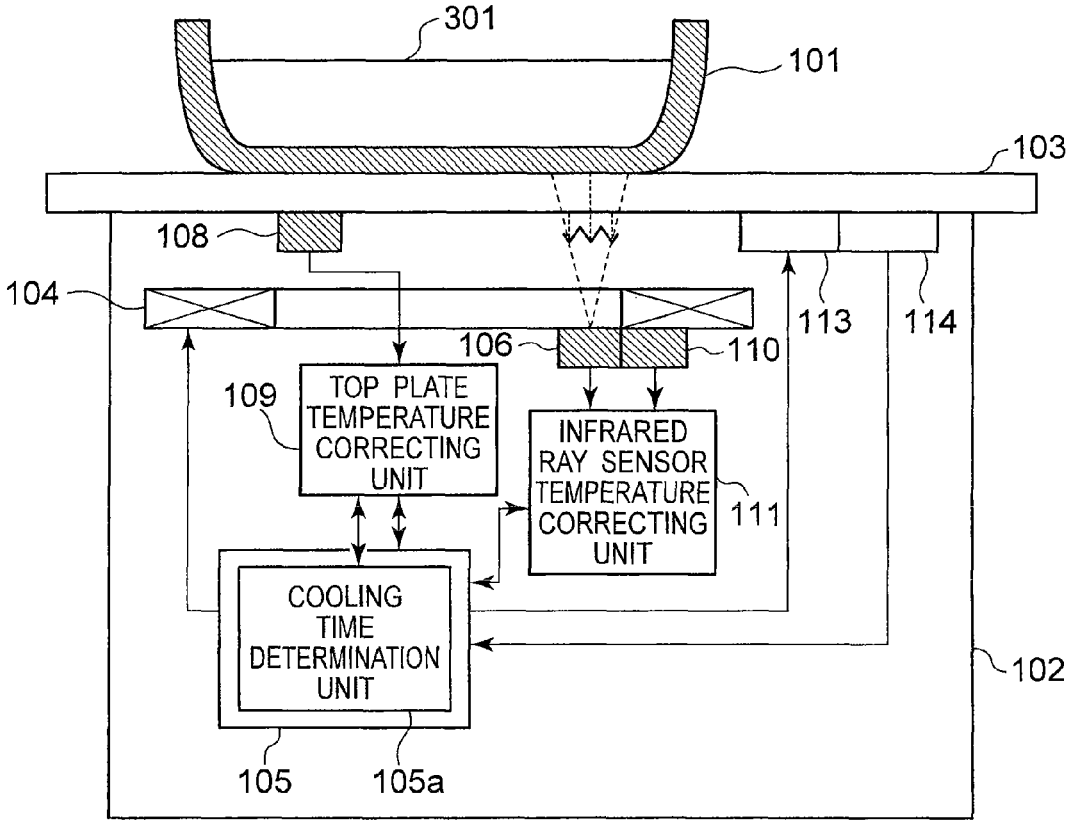
FIG. 9 is a configuration diagram showing schematically an inductive heating cooking device in embodiment 3 of the present invention.

FIG. 9 is a configuration diagram schematically showing the inductive heating cooking device in embodiment 3 of the present invention. In FIG. 9, a cooking material 301 is present in the cooking container 101. In the inductive heating cooking device of the embodiment, the control unit 105 has a cooling time determination unit 105*a* configured to determine a cooling time until the temperature of the cooking container 101 and the temperature of the cooking material 301 are matched after stopping of heating by the heating coil 104. In the embodiment, the other configuration is the same as that in embodiment 1, and the detailed description is omitted.

Figure 10:
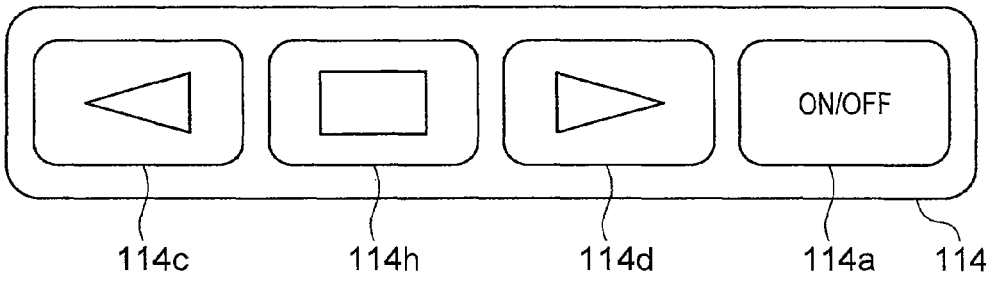
FIG. 10 is a configuration diagram of an input unit in embodiment 3 of the present invention.

FIG. 10 is a configuration diagram of the input unit 114 in embodiment 3 of the present invention. In this embodiment, the input unit 114 includes an on/off switch 114*a* configured to receive an input instruction of starting or stopping of heating of the cooking container 101, a constant cooking material temperature switch 114*h* configured to receive an input instruction for maintaining the temperature of the cooking material 301 at a temperature within a specified range (for example, holding temperature±5 deg. C.) from the temperature (holding temperature) when receiving an operation, a first adjusting switch 114*c* configured to receive an input instruction for lowering the holding temperature, and the second adjusting switch 114*d* configured to receive an input instruction for raising the holding temperature.

3.2 Operation of Inductive Heating Cooking Device

Figure 11:
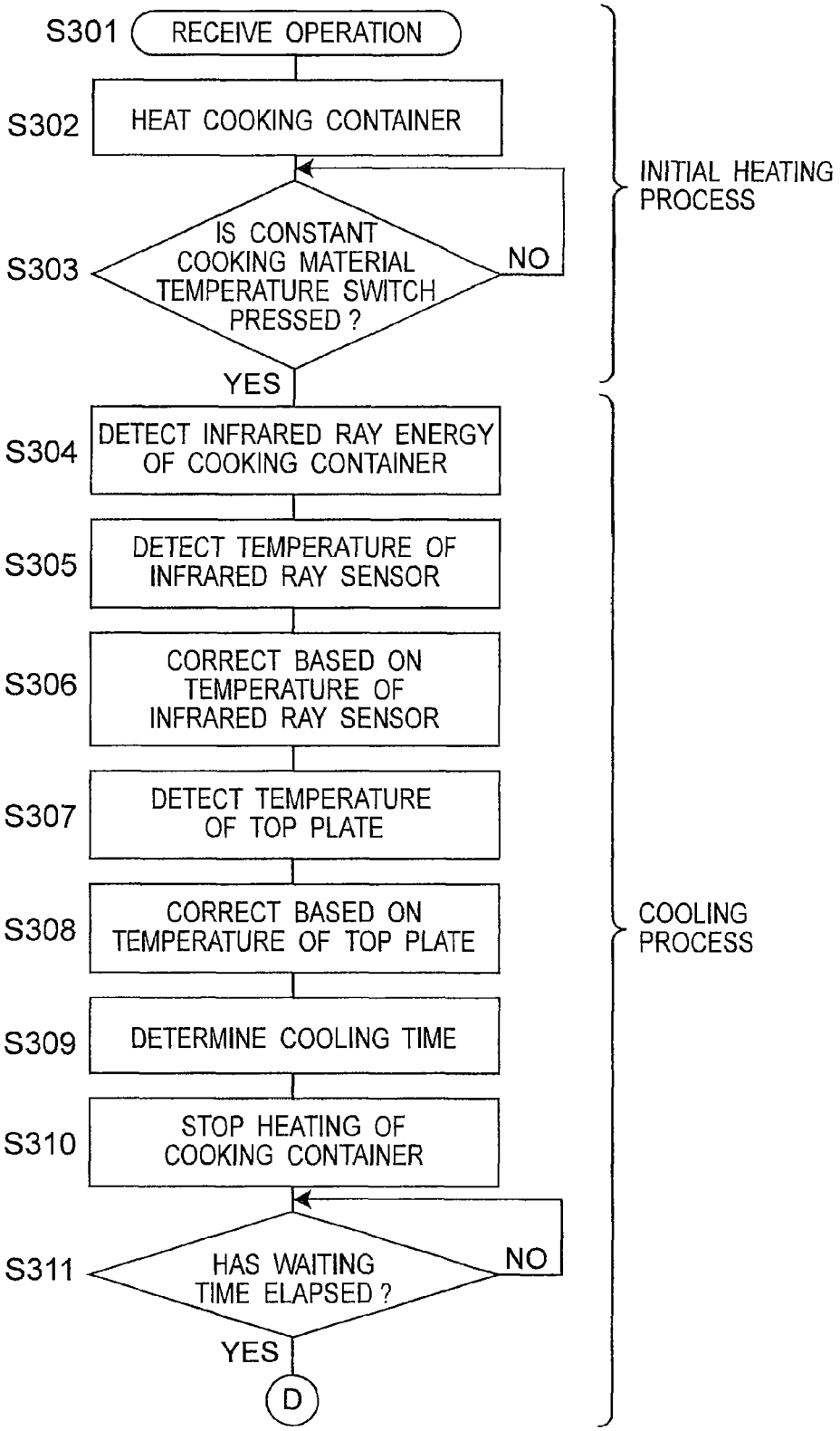
FIG. 11 is a flowchart showing an operation sequence in embodiment 3 of the present invention.
Figure 12:
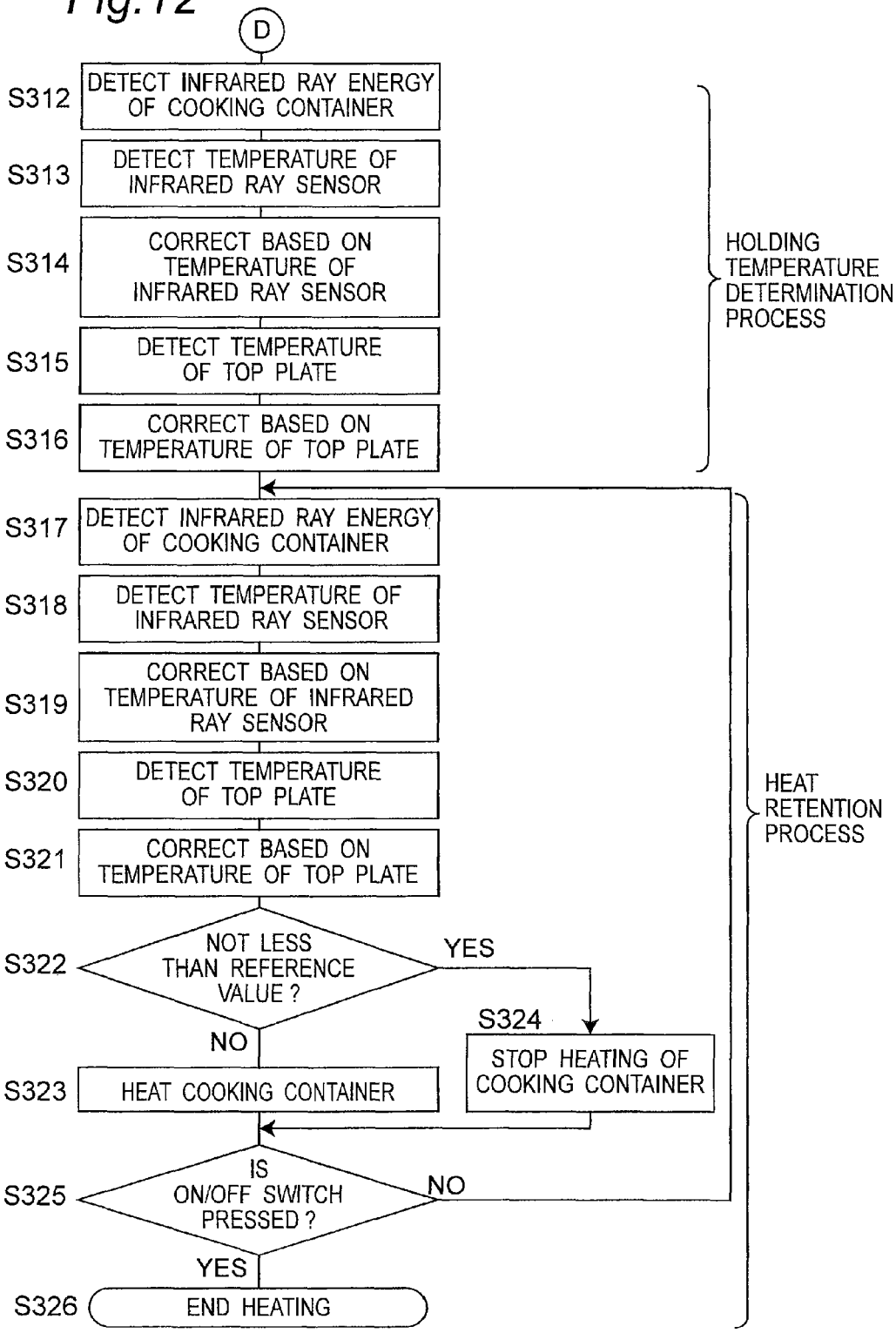
FIG. 12 is a flowchart in succession to FIG. 11.

Referring to FIG. 11 and FIG. 12, at the time of manipulation of the constant cooking material temperature switch 114*h*, the operation of the control unit 105, the infrared ray sensor temperature correcting unit 111, and the top plate temperature correcting unit 109 of the embodiment is explained below. FIG. 11 and FIG. 12 are flowcharts showing the operation sequence in embodiment 3 of the present invention. FIG. 12 shows a flow subsequent to FIG. 11. In this embodiment, until the constant cooking material temperature switch 114*h* is pressed by the user, the control unit 105 controls the heating coil at a predetermined electric power (S301 to S303). When the constant cooking material temperature switch 114*h* is pressed, the control unit 105 actuates the cooling time determination unit 105*a* and executes cooling (stopping of heating) of the cooking container 101 (S304 to S311), and the temperature of the cooking material (that is, the temperature of the cooking container 101 after cooling) is determined as the holding temperature (S312 to S316). Then, the control unit 105 applies electric power to the heating coil 104 and stops applying the electric power so as to maintain the temperature of the cooking material at a temperature within a specified range from the holding temperature when the constant cooking material temperature switch 114*h* is pressed (S317 to S326). The operation of the embodiment is specifically described below.

The user presses the on/off switch 114*a*, the control unit 105 receives the user's operation on the on/off switch 114*a* (S301), and then the control unit 105 applies a predetermined electric power to the heating coil 104, and starts heating of the cooking container 101 (S302). Herein, the predetermined electric power is the initial electric power upon start of heating, which is preliminarily stored in the control unit 105.

Then, the control unit 105 judges whether or not the constant cooking material temperature switch 114*h* is pressed (S303). If the constant cooking material temperature switch 114*h* is not pressed (No at S303), the control unit 105 continues heating at the initial electric power until the constant cooking material temperature switch 114*h* is pressed.

When the constant cooking material temperature switch 114*h* is pressed (Yes at S303), the control unit 105 first absorbs the difference in the temperature of the cooking container 101 and the temperature of the cooking material 301 (S304 to S311), and calculates an output value of the infrared ray sensor 106 corresponding to the temperature of the cooking material 301 when the constant cooking material temperature switch 114*h* is pressed (that is, the temperature of the cooking container 101 after the difference in the temperature is absorbed) (S312 to S316). Specifically, first, the control unit 105 actuates the cooling time determination unit 105*a*. The cooling time determination unit 105*a* determines the cooling time necessary for absorbing the difference in the temperature of the cooking container 101 and the temperature of the cooking material 301 based on the output of the infrared ray sensor 106. The operation from S304 to S308 is nearly same as the operation from S105 to S109 in FIG. 3.

First, the control unit 105 detects the infrared ray energy radiated from the cooking container 101 by means of the infrared ray sensor 106, and actuates the infrared ray sensor temperature correcting unit 111 in order to correct the detected value of infrared ray energy based on the temperature of the infrared ray sensor 106. The infrared ray sensor temperature correcting unit 111 actuates the infrared ray sensor 106, and detects the infrared ray energy radiated from the cooking container 101 (S304).

When the infrared ray sensor 106 is a photodiode, a current flows into the photodiode due to photovoltaic effect. After the current is converted into a voltage, it is amplified by an operational amplifier, and the infrared ray energy radiated from the cooking container 101 can be detected as a voltage value.

Then, the infrared ray sensor temperature correcting unit 111 actuates the infrared ray sensor temperature detecting unit 110, and detects the temperature of the infrared ray sensor 106 (S305). The infrared ray sensor temperature correcting unit 111 preliminarily stores information about temperature characteristics of the infrared ray sensor 106 (for example, information about value of infrared ray energy corresponding to the temperature of the infrared ray sensor 106, or information about amount of change in infrared ray energy corresponding to the change in the temperature of the infrared ray sensor 106). The infrared ray sensor temperature correcting unit 111 corrects the value of infrared ray energy detected at S304, based on the detected temperature of the infrared ray sensor 106 and the stored information on temperature characteristics of the infrared ray sensor 106, and transmits a corrected value of infrared ray energy to the cooling time determination unit 105*a* (S306).

Then, the cooling time determination unit 105*a* actuates the top plate temperature correcting unit 109 for correcting the value of infrared ray energy radiated from the cooking container 101 based on the temperature of the top plate 103, and transmits the value of infrared ray energy received at S306 to the top plate temperature correcting unit 109.

The top plate temperature correcting unit 109 actuates the top plate temperature detecting unit 108 to detect the temperature of the top plate 103 (S307). The top plate temperature correcting unit 109 preliminarily stores information on infrared ray energy radiated from the top plate 103 (for example, the corresponding information on the temperature of the top plate 103 and the value of infrared ray energy of the top plate 103). The top plate temperature correcting unit 109 corrects the value of infrared ray energy received at S307 based on the detected temperature of the top plate 103 and the stored information on the infrared ray energy, and transmits the corrected value of infrared ray energy to the cooling time determination unit 105*a* (S308). The value of infrared ray energy corrected at S308 is the true value of infrared ray energy radiated from the cooking container 101 when the constant cooking material temperature switch 114*h* is pressed.

The cooling time determination unit 105*a* converts the value of infrared ray energy received at S308 to the temperature of the cooking container 101.

The cooling time determination unit 105*a* determines the cooling time (heating stopping time) of the cooking container 101 necessary for absorbing the difference in the temperature of the cooking container 101 and the temperature of the cooking material 301, based on the converted temperature of the cooking container 101 (S309). Herein, the cooling time determination unit 105*a* preliminarily stores information on cooling time suited to the temperature of the cooking container 101 as shown in FIG. 13.

FIG. 13 shows an example of a table of cooling time suited to the temperature of the cooking container 101 in embodiment 3 of the present invention. As shown in this table, for example, when the temperature of the cooking container 101 is 90 deg. C., the cooling time is 20 seconds, and when the temperature of the cooking container 101 is 105 deg. C., the cooling time is 1 second.

Once the cooling time is determined, the control unit 105 stops applying the power to the heating coil 104, and stops heating of the cooking container 101 (S310). In this state, the control unit 105 waits until the cooling time (waiting time) determined at S309 has elapsed (S311). While waiting, as shown in FIG. 14B, the difference in the temperature of the cooking container 101 and the temperature of the cooking material 301 is absorbed, and the temperature of the cooking container 101 and the temperature of the cooking material 301 become nearly equal to each other (the detail is described below).

After a lapse of the cooling time, the control unit 105 calculates an output of the infrared ray sensor 106 corresponding to the temperature of the cooking material 301 (the temperature of the cooking container 101 after a lapse of the cooling time) (S312 to S316). After a lapse of the cooling time, since the difference in the temperature of the cooking container 101 and the temperature of the cooking material 301 has been already absorbed, the temperature of the cooking container 101 is equal to the temperature of the cooking material 301 when the constant cooking material temperature switch 114*h* is pressed. That is, the temperature of the cooking container 101 after a lapse of the cooling time is the standard temperature (holding temperature) for keeping the temperature of the cooking material 301 constant. The process from S312 to S316 is the same as the process from S105 to S109 in FIG. 3, and the detailed description is omitted. The control unit 105 regards the value of infrared ray energy corrected at S316 as the reference value for starting or stopping the heating of the cooking container 101.

Thereafter, the control unit 105 controls heating so as to keep the temperature of the cooking material 301 at a temperature within a specified range from the temperature (holding temperature) when the constant cooking material temperature switch 114*h* is pressed, based on the output value of the infrared ray sensor 106 corresponding to the temperature of the cooking container 101 (temperature of the cooking material 301) after a lapse of the cooling time calculated at S312 to S316 (S317 to S326). Specifically, the control unit 105 obtains and corrects again the output of the infrared ray sensor 106 in order to obtain the value of infrared ray energy corresponding to the present temperature (S317 to S321). The process from S317 to S321 is the same as the process from S105 to S109 in FIG. 3, and the detailed description is omitted.

Then, the control unit 105 compares the value of infrared ray energy at S321 (the present value) with the value of infrared ray energy at S316 (the reference value), and judges whether or not the present temperature of the cooking container 101 is not less than the holding temperature (S322).

If the value of infrared ray energy at S321 (the present value) is less than the value of infrared ray energy at S316 (the reference value), the control unit 105 judges that the temperature of the cooking container 101 is lower than the holding temperature (No at S322), and the control unit 105 continues to apply the electric power to the heating coil 104 (S323). If the value of infrared ray energy at S321 (the present value) is not less than the value of infrared ray energy at S316 (the reference value), the control unit 105 judges that the temperature of the cooking container 101 is the holding temperature or more (Yes at S322), and the control unit 105 operates to stop applying the electric power to the heating coil 104 (S324). In this manner, the temperature of the cooking container 101 is kept at a temperature within a specified range from the predetermined temperature after a lapse of the cooling time, including at the time of overshooting of heating. As a result, the temperature of the cooking material 301 can be maintained at a temperature within a specified range from the temperature when the constant cooking material temperature switch 114*h* is pressed.

The control unit 105 judges whether or not the on/off switch 114*a* is pressed (S325). If the on/off switch 114*a* is not pressed (No at S325), going back to S317, the process from S317 to S325 is repeated. That is, the process is repeated such that when the temperature of the cooking container 101 is lower than the holding temperature, the electric power is applied to the heating coil 104, and when the temperature of the cooking container 101 is higher than the holding temperature, the application of electric power to the heating coil 104 is stopped. As a result, the temperature of the cooking container 101 can be maintained at a temperature within a specified range from the temperature after a lapse of the cooling time, and hence the temperature of the cooking material 301 can be maintained at a temperature within a specified range from the temperature when the constant cooking material temperature switch 114*h* is pressed.

When the on/off switch 114*a* is pressed (Yes at S325), the control unit 105 stops applying the electric power to the heating coil 104, and terminates heating of the cooking container 101 (S326).

3.3 Summary

FIG. 14A shows a temperature graph of the cooking container 101 and the cooking material 301 without provision of the cooling time, and FIG. 14B shows a temperature graph of the cooking container 101 and the cooking material 301 with provision of the cooling time in embodiment 3 of the present invention.

Generally, the temperature of the cooking container 101 in the heating process is higher than the temperature of the cooking material 301. Accordingly, when a cooling time is not provided, as shown in FIG. 14A, after receiving an operation of the input unit 114, if the temperature of the cooking container 101 is kept at a temperature within a specified range from the temperature when the input unit 114 is operated, the temperature of the cooking material 301 gradually comes closer to the temperature of the cooking container 101 after the input unit 114 is operated, and it is not possible to maintain the temperature of the cooking material 301 at a temperature within a specified range from the temperature when the input unit 114 is operated. On the other hand, when a cooling time is provided, as shown in FIG. 14B, during the cooling time (heating stopping time) after the constant cooking material temperature switch 114*h* is pressed, the temperature of the cooking container 101 is lowered. Accordingly, the temperature of the cooking material 301 in the cooking container 101 is not increased. In other words, during the cooling time after the constant cooking material temperature switch 114*h* is pressed, heating of the cooking container 101 is stopped, so that the difference in the temperature of the cooking container 101 and the temperature of the cooking material 301 is absorbed. Accordingly, in the subsequent process of heating control, by keeping the temperature of the cooking container 101 at a temperature within a specified range from the temperature after a lapse of the cooling time, the temperature of the cooking material 301 may be kept at a temperature within a specified range from the temperature at the time of receiving an operation to the constant cooking material temperature switch 114*h*.

In this embodiment, at S309, the cooling time is determined based on the converted temperature of the cooking container 101 corresponding to the corrected value of infrared ray energy when the constant cooking material temperature switch 114*h* is pressed, but determination of the cooling time is not limited to the embodiment. For example, the cooling time may be determined based on the amount of change in the temperature of the cooking container 101 after the constant cooking material temperature switch 114*h* is pressed. In the case, the same effect as that in the embodiment will be obtained.

In the embodiment, the cooling time determination unit 105*a* stored the information of cooling time suited to the temperature of the cooking container 101 as a table, and the cooling time is determined at step S309 according to this table, but the cooling time may be calculated by a mathematical formula. In the case, the same effect as that in the embodiment will be obtained.

In the meantime, embodiments 1 to 3 may be combined and executed.

In the foregoing embodiments, whole or a part of the inductive heating cooking device may be realized as software that can be executed in a computer having hardware resources such as CPU or memory.

The operation (control) of the inductive heating cooking device explained in embodiments 1 to 3 may be executed in a form of a program cooperating with hard resources such as electric or information appliance, computer, server or the like having CPU (or microcomputer), RAM, ROM, storing or recording device, or I/O. by distributing the program by recording it in magnetic medium, optical medium, or other recording medium, or by using the Internet or other communication line, new functions may be distributed, updated, or installed easily.

Although the present invention has been described in connection with specified embodiments thereof, many other modifications, corrections and applications are apparent to those skilled in the art. Therefore, the present invention is not limited by the disclosure provided herein but limited only to the scope of the appended claims.

INDUSTRIAL APPLICABILITY

The inductive heating cooking device of the present invention is capable of detecting the temperature of the bottom of the pan instantly by detecting directly the temperature of the cooking container using an infrared ray sensor. It is hence effective for keeping the temperature of the cooking container precisely with a specified range from the temperature specified in the input unit, and therefore it is used for an inductive heating cooking device used in a general household.

The invention claimed is:

1. An inductive heating cooking device comprising:

a top plate on which a cooking container is placed;

a heating coil to which a high-frequency current is applied to generate an induction magnetic field for heating the cooking container;

an input unit configured to receive a command for keeping a temperature of the cooking container at a constant temperature;

an infrared ray sensor configured to detect an infrared ray energy radiated from the cooking container through the top plate; and a control unit configured to control the high-frequency current to be applied to the heating coil based on an output of the infrared ray sensor so as to keep the temperature of the cooking container at the constant temperature according to the command received by the input unit, wherein the input unit further includes a constant cooking material temperature switch configured to receive a command for keeping a temperature of a cooking material in the cooking container at the constant temperature, the control unit further includes a cooling time determination unit configured to determine a cooling time for stopping heating, depending on the temperature of the cooking container when the temperature switch is operated, the cooling time determination unit is further configured to determine the cooling time necessary for absorbing a difference in the temperature of the cooking container and the temperature of the cooking material based on the output of the infrared ray sensor;

when the temperature switch is operated, the control unit stops the heating during the cooling time determined by the cooling time determination unit, and controls the high-frequency current to be applied to the heating coil, by reference to an output value of the infrared ray sensor after a lapse of the cooling time.

2. The inductive heating cooking device according to claim 1, wherein the input unit includes an adjusting switch configured to adjust a value of the constant temperature.

3. The inductive heating cooking device according to claim 1, wherein the control unit stores information on an electric power to be applied to the heating coil necessary for keeping the temperature of the cooking container at the constant temperature, and applies the electric power to the heating coil based on the stored information on the electric power.

4. The inductive heating cooking device according to claim 1, further comprising:

a thermal capacity calculating unit configured to calculate a thermal capacity of the cooking material in the cooking container and the cooking container, wherein the control unit stores information on an electric power to be applied to the heating coil necessary for keeping the temperature of the cooking container at the constant temperature, based on the thermal capacity of the cooking material and the cooking container calculated by the thermal capacity calculating unit, and applies an electric power to the heating coil based on the stored information on the electric power.

* * * * *